US005279193A

United States Patent [19]

Huffine

[11] Patent Number: 5,279,193

[45] Date of Patent: Jan. 18, 1994

[54] SCAFFOLD DECK

[75] Inventor: Anthony R. Huffine, Louisville, Ky.

[73] Assignee: Emerson Electric Co., St. Louis, Mo.

[21] Appl. No.: 23,099

[22] Filed: Feb. 26, 1993

[51] Int. Cl.[5] ..... E04G 5/08

[52] U.S. Cl. ..... 182/119; 182/222

[58] Field of Search ..... 182/119, 222, 223, 179, 182/178

[56] References Cited

U.S. PATENT DOCUMENTS 3,782,498 1/1974 Gleisen ..... 182/222 X
4,825,976 5/1989 Wyse ..... 182/119 X
5,069,309 12/1991 Swiderski et al. ..... 182/119
5,141,078 8/1992 Word ..... 182/119 X

*Primary Examiner*—Alvin C. Chin-Shue
*Attorney, Agent, or Firm*—Polster, Lieder, Woodruff & Lucchesi

[57] ABSTRACT

Scaffold mounting structure for mounting a longitudinally extending scaffold deck to a raised framework including a pair of scaffold deck fastening members constructed to be mounted to a scaffold deck end so as to allow a scaffold deck rung to be readily assembled and positioned proximal the scaffold deck end to enhance scaffold stability.

10 Claims, 1 Drawing Sheet

SCAFFOLD DECK

BACKGROUND OF THE INVENTION

The present invention relates to raised framework construction and more particularly to scaffold deck mounting structure for mounting a scaffold deck to a raised framework, such as a vertical scaffold supporting tower formed from joined tubular support rods.

Various types of scaffold support decks are known in the ladder construction art, such support decks usually including a flat support platform mounted on a pair of spaced longitudinally extending rails having spaced rung members extending therebetween. Such scaffold support decks are conveniently manufactured in seven (7), eight (8), and ten (10) feet lengths and have included a number of different types of fastening members at opposite extremities to fasten the decks to raised tower support structure. Not only have these past fastening members been difficult and comparatively expensive to manufacture and assemble but also have often required undesirable modifications to the scaffold deck structure extremities as well as to fastener members themselves which have resulted in undesirable stability and weakness areas in the support members.

The present invention, recognizing the problems of past scaffold deck members provides a unique support structure which can be readily manufactured and assembled to scaffold decks of a generally known type after the scaffold deck has been manufactured with optimum support strengthened and stability and without unnecessary and undesirable changes to rung or brace positioning of end rungs which end rungs desirably should be located proximate the platform ends so as to enhance such desired stability. In addition, the unique and novel structure of the present invention provides for maximum overall stress distribution of a scaffold deck without unnecessary notching or changes in end braces or rungs with concomitant weakness from such notching and changes. Further, the present invention provides a deck fastening member in which both end portions of the fastening members rest in a common plane so as to avoid undesirable stresses from bending, metal working or casting and, at the same time, allowing ready manufacture and assembly in a straight-forward and economical manner. Moreover, the present invention provides a unique fastener member which can readily be positioned and mounted without hollowing structure at any one of the four corners of a longitudinally extending support deck, permitting end-to-end mounting of support decks on raised platform structure with a minimum spacing between adjacent ends of adjacent support decks.

Various other features of the present invention will become evident to one skilled in the art upon reading the disclosure set forth herein.

BRIEF SUMMARY OF THE INVENTION

More specifically, the present invention provides a scaffold deck mounting structure for mounting a longitudinally extending scaffold deck to a raised framework, the support deck including a flat support platform mounted on a pair of spaced rails having spaced rung members extending normally therebetween comprising: at least one pair of frame work fastening members mounted in cantilevering fashion at one end of the scaffold deck in spaced relation to corresponding opposed corners at one end of the longitudinally deck, each fastening member of the pair including an open-ended hook portion and an open-ended shank portion at opposite extremities thereof with the open-ended hook portion cantilevering from the deck end and being sized and geometrically configured to nest with a structural member of the raised framework and the open-ended shank portion being sized and geometrically configured to be surroundingly positioned around at least one rung to be securely fastened to a face of one of the pair of side rails.

It is to be understood that various changes can be made by one skilled in the art in one or more of the parts of the disclosed structure without departing from the scope or spirit of the present invention.

BRIEF DESCRIPTION OF THE DRAWINGS

Referring to the drawings which disclose one advantageous embodiment of the present invention.

DETAILED DESCRIPTION OF THE DRAWINGS

Figure 1:
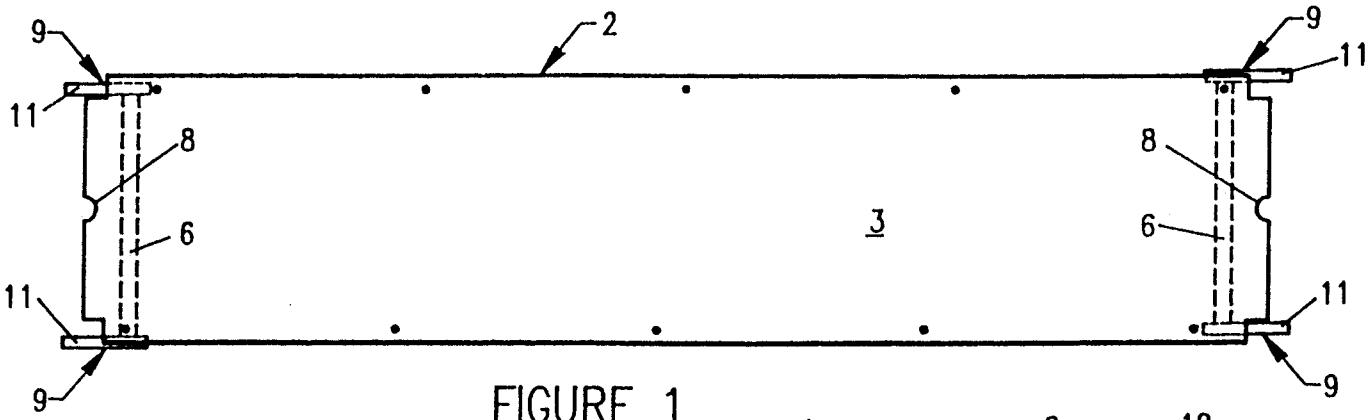
FIG. 1 is a plan view of a scaffold deck incorporating the novel features of the present invention.
Figure 2:
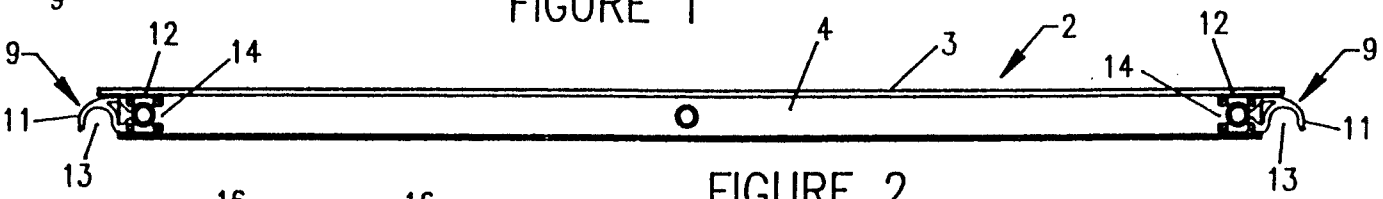
FIG. 2 is a side view of the scaffold deck of FIG. 1.
Figure 3:
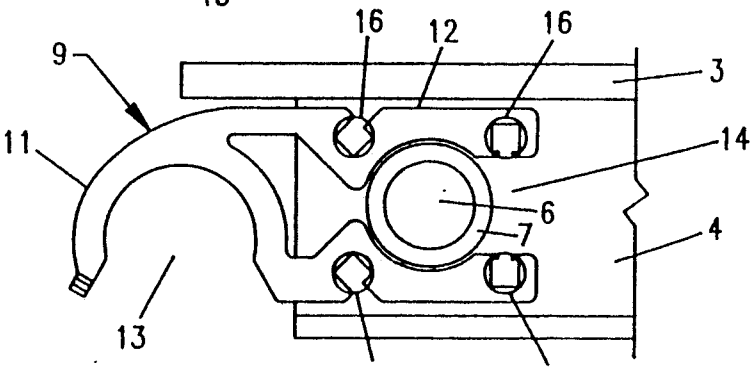
FIG. 3 is an enlarged end side view of one of the fastening members associated with the scaffold deck of FIGS. 1 and 2.

As can be seen in FIGS. 1 and 2 of the drawings, a longitudinally extending scaffold deck 2 is disclosed. This deck 2 advantageously can be any one of several known commercial lengths, generally of seven (7), eight (8) or ten (10) feet in length and generally of a preselected established width, for example, approximately nineteen (19) inches. Broadly, the deck includes a flat platform support 3, a pair of spaced parallel rails 4 (only one being disclosed in FIG. 2) and a set of appropriate number of spaced rung members 6 (only the end ones being shown by broken lines in FIG. 1) extending normally to the spaced parallel rails to be joined thereto at the rung extremities, forming beads 7 (FIG. 3) along opposite faces of each rail 4. The longitudinally extending platform support 3 can be formed from a suitable material such as a sheet of wood or metal of suitable strength and thickness to include a grip recess 8 at each of the opposite extremities thereof. The pair of spaced rails 4 and rungs 6 can be of a suitable metal, such as aluminum, with rails 4 generally being of I-beam cross-section and rung 6 generally being of "D" or circular cross-section as is shown. It is to be noted that in accordance with one feature of the present invention, the spaced rungs 6 advantageously include rungs proximately adjacent the opposite ends of the scaffold deck 2 so as to improve deck stability and deck support strength. It is to be understood that in accordance with still another manufacturing feature of the present invention, the scaffold deck 2 including longitudinally extending platforms support 3, longitudinally extending spaced parallel rails 4 and normally extending, spaced rungs 6 can be assembled as a scaffold deck unit 2 before the two novel pairs of framework fastening members 9 are mounted in cantilevered fashion to the assembled scaffold deck 2. In this regard, one pair of spaced fastening members 9 is mounted at one end of a longitudinally extending scaffold deck 2 and the other pair of fastening members 9 is mounted at the opposite end of the longitudinally extending scaffold deck. Fastening members 9 can be formed from any one of a number of suitably light, strong structural metals, such as aluminum. Four identical fastening members are utilized with each deck 2 in two pairs as disclosed. Each pair of fastening members 9 is mounted in spaced relation to corresponding opposed corners of the end of scaffold deck to which it respectively is mounted. Each of the identical fastening members 9 includes in a common plane, as can be readily seen in FIG. 3 of the drawings, an open-ended cantilevering hook portion 11 and an open-ended shank portion 12 at opposite extremities thereof with the openings 13 and 14 respectively being axially normal to each other with the opening 14 of shank portion 12 extending along the longitudinal axis of one face of a rail of the rail pair 4 to which it is mounted and the opening 13 of cantilevered hook portion extending downwardly relative a vertically standing framework (not shown).

In the embodiment disclosed, opening 13 is semi-circularly shaped so as to be sized and geometrically configured to engage with a tubular structural member of a raised framework. The opening 14 in shank portion 12 has the upstream lead end sufficiently sized to be surroundingly positioned around an end rung 6 of scaffold deck 2 with the downstream part of opening 14 being sufficiently sized to be surroundingly positioned around bead 7 formed by the fastening of the end of rung 6 to the faces of one of the pair of deck rails 4. It is to be noted in FIG. 3, that the opening 14 in shank portion 12 is provided with four spaced aperture recesses 16 which surround opening 14 and which extend to the side edges of shank portion. These apertures 16 serve to receive suitable bolts for attachment of a fastening member 9 to a side face of a deck rail 4. It also is to be noted, that a fastening member 9 of one pair of fastening members at one end of scaffold deck 2 has the shank portion 12 fastened to one of the two opposed faces at one end of a spaced rail 4 of deck 2 and the other fastening member 9 of such pair at such end has its shank portion 12 fastened to the other of two corresponding opposed faces of the other of the one pair of spaced, parallel rails 4 of scaffold deck 2. The other pair of fastening members 9 at the other end of scaffold deck 4 is fastened to the respective rail faces of the rail pair 4 in reverse order. Such an arrangement permits interlapping of the cantilevering hook portions 11 of adjacent fastening members 9 of end-to-end scaffold decks 2 (only one being shown). This arrangement permits adjacently mounted ends of adjacent longitudinally extending scaffold deck platforms 3 to be in minimal spaced proximity with semi-circular grip recesses 8 mating to allow for ready hand lifting of adjacent decks 2.

From the above, it can be seen that a unique structural arrangement for a scaffold deck is provided which allows for economic and straight-forward manufacture, assembly and disassembly, the scaffold deck being firm and stable without undue stresses thereon.

The invention claimed is:

1. Scaffold deck mounting structure for mounting a longitudinally extending scaffold deck to a raised framework, said scaffold deck including a flat support platform mounted on a pair of spaced rials having spaced rung members extending normally therebetween with beads formed between rung member ends and said spaced rails comprising: at least one pair of framework fastening members mounted in cantilevering fashion at one end of said scaffold deck in spaced relation to corresponding opposed corners at one end of said longitudinally extending deck, each fastening member of said pair including an open-ended hook portion and an open-ended shank portion at opposite extremities thereof with said open-ended hook portion cantilevering from said deck end and being sized and geometrically configured to nest with a structural member of said raised framework and said open-ended shank portion being sized and geometrically configured to straddingly partially encircle and be surroundingly positioned around at least one end rung to be securely fastened to a face of one of said pair of side rails.

2. The scaffold mounting structure of claim 1, said structure including two pairs of framework fastening members mounted in oppositely cantilevering fashion at opposite ends of said scaffold deck.

3. The scaffold mounting structure of claim 1, the hook and shank portions of each fastening member resting in a common plane.

4. The scaffold mounting structure of claim 1, said cantilevered open-end hook portion having the opening thereof extending downwardly in a direction substantially normal to the longitudinal axes of said spaced rails of said scaffold deck.

5. The scaffold mounting structure of claim 1, said open-end shank portions of said fastening members having the openings thereof extending in a direction substantially parallel and along the longitudinal axes of said spaced rail.

6. The scaffold mounting structure of claim 1, said cantilevered open-end shank portions of said fastening members having openings sufficiently sized to engage around said beads formed between said rung ends and said spaced rails of the scaffold deck.

7. The scaffold mounting structure of claim 1, said open-end shank portions of said fastening members having openings at the lead ends thereof sufficiently sized to straddle and partially encircle around rung extremities and sufficiently sized to be surroundingly positioned around said beads formed between said rung ends and said spaced rails of said scaffold deck.

8. The scaffold mounting structure of claim 1, said open-end shank portions having spaced apertured recesses therein surrounding said opening and extending to the edges of said shank portions to receive fastening bolts for attachment of said fastening members to side faces of adjacent deck rails.

9. The scaffold mountings structure of claim 1, wherein one fastening member of said pair has its shank portion fastened to one of two opposed faces of one of the pair of spaced rails of said scaffold deck and the other fastening member of said pair having its shank portion fastened to the other of the two opposed faces of the other of the pair of spaced scaffold deck rails of said scaffold deck to permit interlapping of adjacent fastening members to end-to-end mounted scaffold decks.

10. Scaffold mounting structure for mounting a longitudinally extending scaffold deck to a raised vertically standing framework, said scaffold deck including a flat platform mounted on a pair of spaced rails each rail of said pair of spaced rails including opposed inside and outside faces with said pair of spaced rails, having sets of spaced apart rung members extending normally therebetween with beads formed between rung member ends and certain of said faces, of said rails, said sets of spaced apart rungs including rungs proximately adjacent opposite ends thereof comprising: two paris of framework fastening members mounted in cantilevered fashion with one pair mounted at one end of said longitudinally extending scaffold deck and the other pair mounted at the opposite end of said longitudinally extending scaffold deck and with each pair of said fastening members mounted in spaced relation to corresponding opposed corners of the end of said scaffold deck to which it is respectively mounted, each fastening member being substantially identical to include in a common plane an open-ended cantilevering hook portion and an open-ended shank portion at opposite extremities thereof with the openings being axially normal to each other with the opening of the shank portion extending along the longitudinally extending axis of one of the two inner and outer opposed faces of the rail to which it is mounted and the opening to the cantilevered portion extending downwardly relative a vertically standing framework and being semicircularly sized and geometrically configured to engage with a tubular structural member of said raised vertical framework, said open-end shank portion having its opening at its lead end sufficiently sized to straddingly partially encircle and be surroundingly positioned around an end rung of said deck and being sufficiently sized to be surroundingly positioned around said bead formed by the fastening of a rung end to a deck rail of a deck rail pair, said open-end shank portion having four spaced aperture recesses therein surrounding said opening and extending to the side edges of said shank portion to receive bolts for attachment of said fastening member to one of said opposed inside and outside faces of an adjacent deck rail with one fastening member of one pair of fastening members at one deck end having its shank portion fastened to one of the two opposed inside and outside faces of one of the spaced rails of said scaffold deck and the other fastening member of said one pair having its shank portion fastened to the other of said two corresponding opposed inside and outside faces of the other rail of the one pair of spaced rials of said scaffold deck and the other pair of fastening members at the other deck end being fastened to the respective opposed inner and outer rail faces of the rail pair in reverse order to permit interlapping of adjacent fastening members of end-to-end mounted scaffold decks to permit adjacent ends of adjacent longitudinally extending deck platforms to be in minimal spaced proximity.

* * * * *